US005875821A

United States Patent [19]

Dumser et al.

[11] Patent Number: 5,875,821

[45] Date of Patent: Mar. 2, 1999

[54] HOUSING FOR RECEIVING INDIVIDUAL COMPONENTS OF A HEATING OR COOLING INSTALLATION

[75] Inventors: Josef Dumser, Landau; Karl-Heinz Kolaska, Löwenstein, both of Germany

[73] Assignees: Dumser Mettallbau GmbH & Co. KG, Landau; Storopak Hans Reichenecker GmbH & Co., Metzingen, both of Germany

[21] Appl. No.: 790,493

[22] Filed: Jan. 29, 1997

[30] Foreign Application Priority Data

Jan. 29, 1996 [DE] Germany ..... 296 01 458.3

[51] Int. Cl.[6] ..... F16L 9/00

[52] U.S. Cl. ..... 138/162; 138/157; 138/166; 138/168; 220/780; 174/101

[58] Field of Search ..... 138/162, 163, 138/165, 166, 167, 168, 156, 157; 220/780, 796; 215/224, 317; 174/101

[56] References Cited

U.S. PATENT DOCUMENTS

| | | | |
|---|---|---|---|
| 2,023,047 | 12/1935 | Ganoe | 138/166 |
| 3,055,399 | 9/1962 | Bush et al. | 138/167 X |
| 3,126,444 | 3/1964 | Taylor | 138/165 X |
| 3,425,456 | 2/1969 | Schibig | 138/162 |
| 3,757,031 | 9/1973 | Izraeli | 138/162 X |
| 4,260,181 | 4/1981 | Curtin | 138/162 X |
| 4,865,890 | 9/1989 | Erlichman | 138/167 X |
| 5,443,096 | 8/1995 | King | 138/162 X |

FOREIGN PATENT DOCUMENTS

| | | | |
|---|---|---|---|
| 74402 | 5/1970 | Germany | 138/162 |

*Primary Examiner*—Patrick F. Brinson
*Attorney, Agent, or Firm*—Cohen, Pontani, Lieberman, Pavane

[57] ABSTRACT

A housing for receiving individual components of a heating or cooling installation is formed of at least two shells of thermally insulating plastic which enclose the components between themselves. The shells are provided at their respective facing edges with a rabbet connection formed of a rabbet strip and a groove strip corresponding thereto in shape and dimensions. The flank of the groove strip of the bottom shell which cooperates with the rabbet strip is divided into an upper partial surface inclined relative to the rabbet strip at an angle $\alpha$ to the normal line and a lower partial surface which is inclined at an angle $\beta$ to the normal line. The angles $\alpha$ and $\beta$ have opposite rotational directions. The rabbet strip of the top shell has surfaces corresponding to the surfaces of the groove strip so as to substantially facilitate closing and opening of the housing.

7 Claims, 3 Drawing Sheets

Fig.4
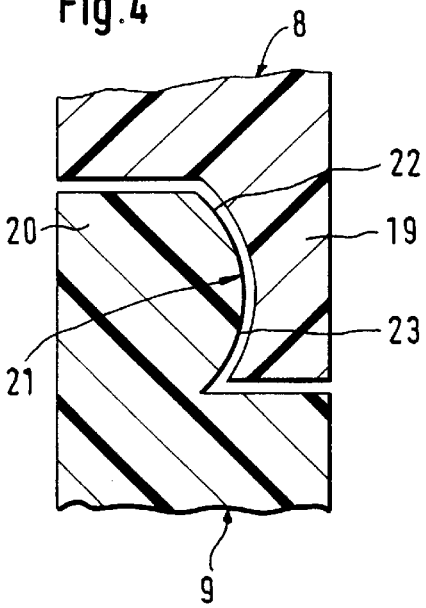
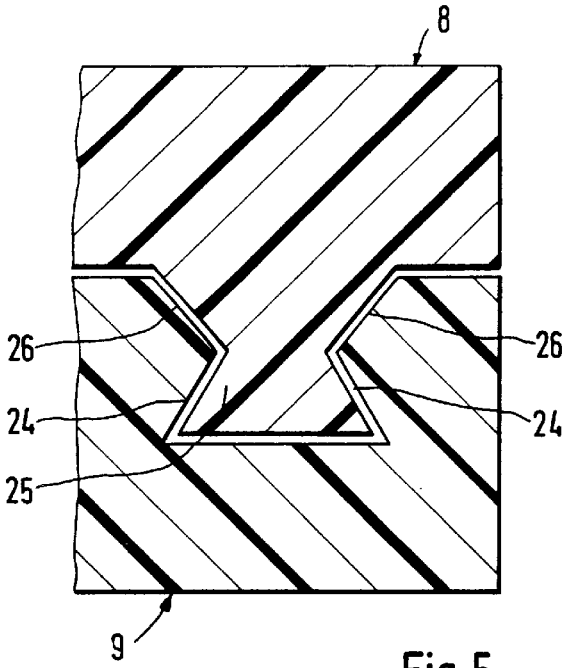
Fig.5
Fig.6
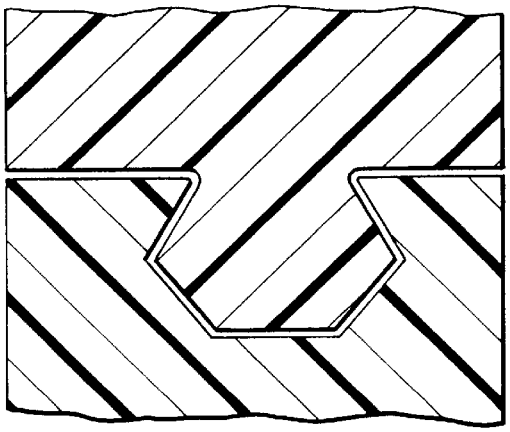
Fig.7
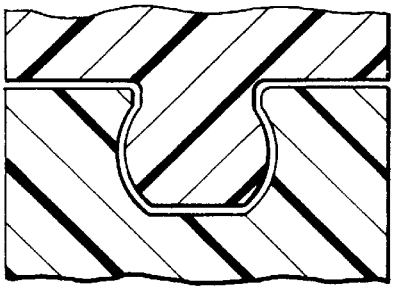

HOUSING FOR RECEIVING INDIVIDUAL COMPONENTS OF A HEATING OR COOLING INSTALLATION

BACKGROUND OF THE INVENTION

1. Field of the Invention

The invention relates to a housing for receiving individual components of a heating or cooling installation.

2. Discussion of the Prior Art

For cladding and thermal insulation of pipelines, one-piece coverings, made from thermally insulating material in the form of cylindrical jackets, are slid over the lines in a known manner. The coverings may be several centimeters thick. Because of its one-piece construction, this cladding has a very favorable heat insulating capacity. Heat bridges such as occur when two shells are butt-jointed are prevented to a great extent. However, this cladding can be fitted only by sliding it over the pipeline from a free end of the pipeline. The cladding is not suitable for subsequently providing an already installed heating installation with heat insulation. For pipe inspection purposes, such coverings must be cut along their length. The cut up coverings can be reused only at the expense of a diminished heat insulating capacity.

For these reasons, half-shells which are connected by a butt joint at their connecting locations have also been used as thermally insulating coverings for pipelines. To hold the shells together, the joint location is covered with an adhesive strip connecting the outer surface areas of the two half-shells along the joint location. Although this design enables subsequent fitting of cladding and inspection of pipelines, it requires a complicated and time-consuming gluing of the joint location. In addition, a butt joint always poses the risk of unwanted heat transfer.

Finally, in a known manner, piping, connections and fittings of a heating or cooling installation which are combined in ready-to-install structural components are accommodated in a housing comprising two half-shells made from heat-insulating plastic, in particular expanded polypropylene. In order to close the two half-shells simply and quickly and to prevent heat bridges, the joint area is not flush but, instead is constructed in the form of a single-undercut mortise or rabbet on one half-shell and a corresponding groove on the other half-shell (EP 0 561 037 A1). When the two half-shells are pressed together, a snapping in and interlocking take place via the undercut surfaces.

In order for the two half-shells to be pressed together enabling the undercut surfaces to snap together, the undercut rabbets lying at right angles to the movement direction of the half-shells must be placed exactly one upon the other by their planar partial surfaces, since the vertical pressure to be applied for snapping in must cause a yielding toward the side exclusively by means of the elasticity of the material so that the edge of the upper rabbet can slide over that of the lower rabbet. This accuracy of position can often not be accomplished in the field. If this is not achieved, tilting will cause the rabbet connection to snap in at one edge but not at the opposite edge which results in an incomplete enclosure of the pipe.

SUMMARY OF THE INVENTION

Accordingly, it is an object of the present invention to provide an insulating housing in which the connection area is constructed so that the individual shell-type housing parts can be put together quickly and easily so as to form a self-locking connection which extensively prevents heat losses.

Pursuant to this object, and others which will become apparent hereafter, one aspect of the present invention resides in a housing comprised of at least two shells of thermally insulating plastic which are configured to enclose heating and cooling components between the shells. The shells, respectively, have facing edges. Rabbet connection means are arranged on the facing edges of the shells and include a rabbet strip on the facing edges of a first one of the shells and a groove strip corresponding in shape and dimension to the rabbet strip on the facing edges of a second one of the shells. The rabbet strip is engagable with the groove strip so that the shells interlock positively along a contacting plane. The groove strip of the second shell has a flank that is divided into an upper partial surface which is inclined relative to the rabbet strip at an angle $\alpha$ to a normal line, and a lower partial surface which is inclined at an angle $\beta$ to the normal line. The angles $\alpha$ and $\beta$ have opposite rotational directions. The rabbet strip of the first shell has surfaces configured to correspond to the upper and lower partial surfaces of the groove strip.

The basic idea of the invention is that a guide surface is provided in addition to the undercut locking surface of the rabbet. When two half-shells are pressed together, the lower inner edge of the rabbet strip first encounters the inclined guide surface of the groove at the other half-shell and slides along it. In so doing, a gradual elastic widening of the rabbet strip is effected. In passing from the guide surface to the locking surface, the rabbet strip snaps into the locking surface due to its elastic behavior and holds the two half-shells together. During this process, the circumferentially extending guide surface at the same time centers the half-shells relative to one another. Accordingly, the half-shells no longer need to lie exactly one above the other when assembling the housing; it is sufficient that the rabbet strip lie in the region of the guide surface. This substantially facilitates the closing of the housing.

The construction of the rabbet connection according to the invention further ensures that the rabbet connection will not be overworked by excessive bending of material in the face of repeated closing and opening of the shells as required for repair and inspection.

A further advantage of the inventive construction is that no continuous gap can be formed in the joint due to the combination of locking and guiding surfaces. At least one of the two surfaces contacts the other half-shell by its corresponding mating surface. The risk of a heat bridge in the butt joint is accordingly eliminated.

Furthermore, manufacturing tolerances caused by shrinkage are compensated for by this construction of the rabbet connection.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

In the drawing:

FIGS. 4 to 7 are cross sectional views of additional embodiments of the rabbet connection.

DETAILED DESCRIPTION OF THE PREFERRED EMBODIMENTS

Figure 1:
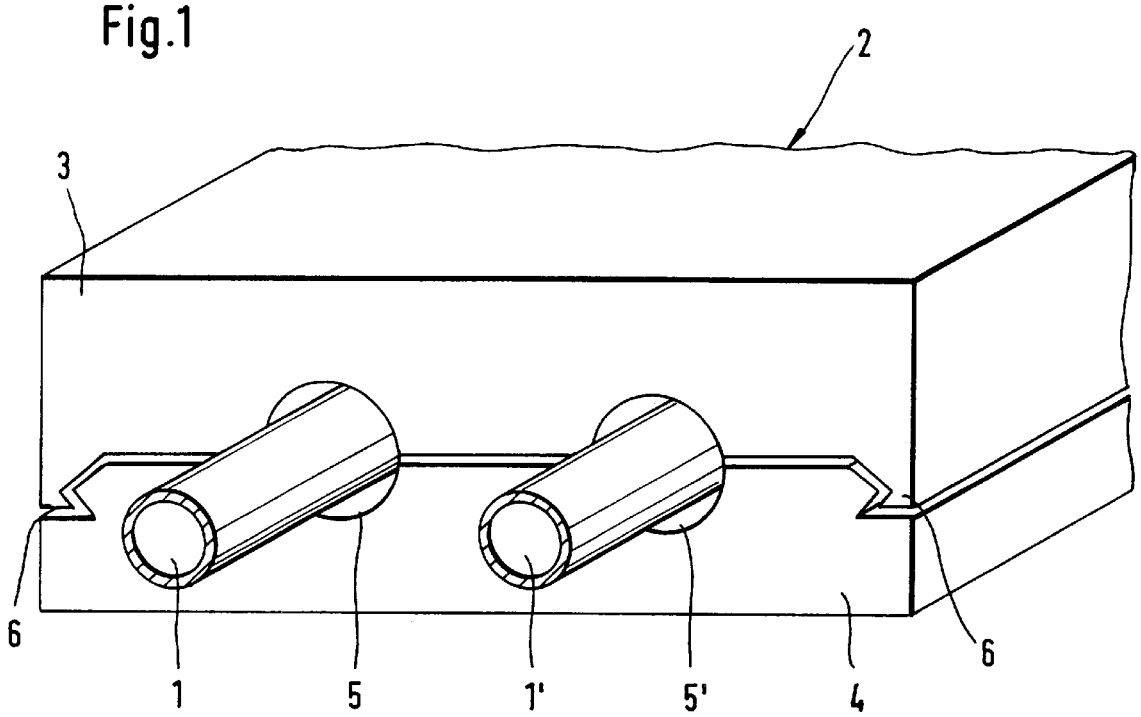
FIG. 1 is a perspective view of a housing used for thermal insulation of pipelines.

FIG. 1 shows the invention used as thermal insulation for pipelines. The figure shows two pipelines 1, 1' in which a heating or cooling medium circulates. The two pipelines 1, 1' are embedded in a housing 2 made of thermally insulating material to prevent energy losses caused by a transfer of heat or cold to the environment. Expanded polypropylene (EPP) is particularly suitable as the thermally insulating material; however, expanded polyethylene (EPE), polystyrene (EPS), or the like, are also possible.

Apart from the thermal insulation capacity, other important material characteristics include strength, which determines the forces which can be transmitted into the connection joint, and elasticity which is a necessary condition for automatic locking.

In the embodiment shown in the drawing, the housing 2 is formed of two solid-walled half-shells, in this instance a top half-shell 3 and a bottom half-shell 4 which lie one on top of the other along the greater part of their surface. Each of the two half-shells 3, 4 receives half of the pipeline 1, 1' in cut out portions 5, 5' expressly provided for that purpose. The half-shells 3, 4 are connected with one another at the edges in a positive and frictional engagement via a rabbet connection 6 shown in larger scale in FIG. 3.

Figure 2:
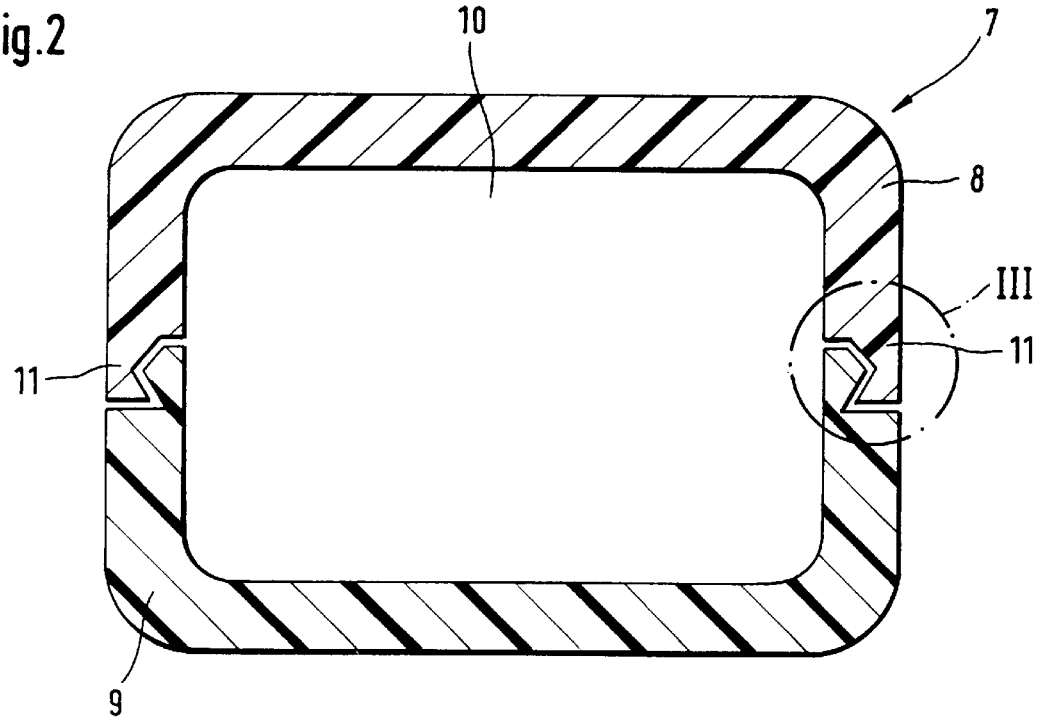
FIG. 2 is a cross section through a thin-walled embodiment of a housing according to the present invention.

FIG. 2 shows another embodiment of a housing 7 according to the invention. In this case, also, the housing 7 is formed of a top shell 8 and a bottom shell 9. In contrast to the housing 2 described in FIG. 1, however, the half-shells 8, 9 are thin-walled and enclose a hollow space 10. For example, a ready-to-install structural component group of a heating installation may be arranged in this cavity 10. The top shell 8 and bottom shell 9 are connected with one another at their shared contact face in a positive and frictional engagement by means of a rabbet construction 11 according to the invention.

Figure 3:
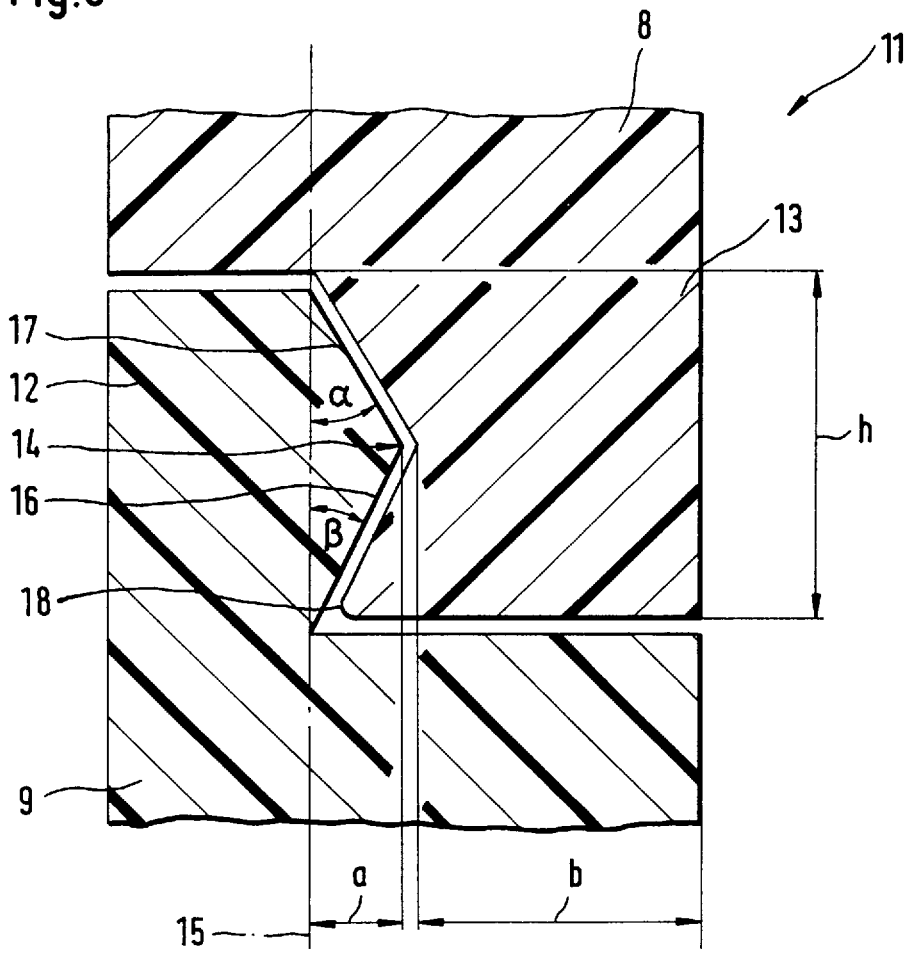
FIG. 3 is an enclosed detail III through a rabbet connection according to the invention in FIG. 2.

FIG. 3 is a detail III of FIG. 2, showing the connection point between the top shell 8 and bottom shell 9 in enlarged scale. At the shared contacting surface of the two half-shells 8, 9, the bottom shell 9 has a groove strip 12 and the top shell 8 has a rabbet strip 13 corresponding to the groove strip 12. In its base region, the flank 14 of the groove strip 12 of the bottom shell 9, which cooperates with the rabbet strip 13, comprises a locking surface 16 which is inclined relative to the rabbet strip 13 at an angle $\beta$ to the normal line 15 and a guide surface 17 which adjoins the locking surface 16 so as to be inclined in the opposite direction at an angle $\alpha$ to the normal line 15. The ratio of dimensions of the locking surface 16 to the guide surface 17 can vary depending on the intended use. In the example shown, the two surfaces 16 and 17 and both angles $\alpha$ and $\beta$ are the same size. If the holding capacity of the connection is of secondary importance compared with a simple and easy closing of the housing 7, the guide surface 17 can be increased at the expense of the locking surface 16 by selecting a smaller angle of inclination $\alpha$ while keeping constant the height h of the rabbet. This also holds true in the reverse case.

The construction of the rabbet strip 13 of the top shell 8 corresponds to that of the groove strip 12 with respect to shape and size. Like the inclination angles $\alpha$ and $\beta$ of the guide surface and locking surface 17, 16 respectively, and the distance a between the rabbet edges determined thereby, the width b of the rabbet strip 13 at the narrowest point and its height h are so dimensioned that a snap-in effect can be achieved depending on the elasticity and restoring forces of the material used without the material wearing out after frequent opening and closing of the housing 7. The lower corner 18 of the rabbet strip 13 is advisably somewhat rounded.

FIG. 4 shows an embodiment of the rabbet connection as an alternative to that shown in FIG. 3. In this case, the flank 21 of the groove strip 20 cooperating with the rabbet strip 19 is convex so that the upper half of the flank 21 forms the guide surface 22 and the lower half of the flank 21 forms the locking surface 23 which adjoins the guide surface 22 so that the guide surface 22 and the locking surface 23 have an equal curvature and pass into one another in a continuous manner. This connection works in a manner corresponding to that of the embodiment form shown in FIG. 3 so that the dimensions of the rabbet must also in this instance be so adapted to the material characteristics that the deformation occurring when closing and opening remains in the elastic range.

If the locking forces between the top shell 8 and bottom shell 9 are not expected to be sufficient, the rabbet connections shown in FIGS. 3 and 4 can also be constructed symmetrically in order to increase these forces. In so doing, the locking surface 24, which is decisive for the composite action, is doubled. FIG. 5 shows such an embodiment. The rabbet strip 25 slides along the guide surfaces 26 when the half-shells 8 and 9 are pressed together as a result of the modified dovetail construction of the groove and rabbet strip 25. For this purpose, the two pointed ends of the dovetail-shaped rabbet strip 25 are partially elastically flattened and partially bent until passing the narrowest point of the groove which is likewise dovetail-shaped. Only then is it possible to snap into the locking surfaces 24 due to the restoring forces of the material. A connection of this type naturally occupies more space in the joint direction than the single construction, but prevents a possible deformation of the shells 8 and 9 which could occur when snapping in. For this reason, it is especially suitable for the types of housing described, e.g., in FIG. 1.

In the examples shown, the groove and the rabbet strip engage one inside the other in accordance with the principle of a male and female mold for the meshing of the surfaces, the raised portions occurring in the flank surface of the groove. It is also possible to have rabbet connections whose raised portions are arranged in the rabbet strip and engage in depressions in the groove and thus result in a locking of the half-shells. FIGS. 6 and 7 show examples of such constructions. With respect to operation, FIG. 7 corresponds to FIG. 4 and FIG. 6 corresponds to FIG. 5.

The invention is not limited by the embodiments described above which are presented as examples only but can be modified in various ways within the scope of protection defined by the appended patent claims.

I claim:

1. A housing for receiving individual components of heating and cooling installations, comprising:

at least two shells of an expanded thermally insulating plastic which are configured to enclose the components between the shells, the shells having, respectively, a main outer face and two lateral side faces which have an end edge lateral to the side surface, the shells being arranged so that the lateral end edges of a first one of the shells face the lateral end edges of a second one of the shells; and rabbet connection means arranged on the facing edges of the shells and including a rabbet strip on the facing edges of the first one of the shells and a groove strip, corresponding in shape and dimension to the rabbet strip, on the facing edges of the second one of the shells, the rabbet strip being engagable with the groove strip so that the shells interlock positively and releasably along a contacting plane, the groove strip of the second shell has a flank that is divided into an upper partial surface which is inclined relative to the rabbet strip at an angle $\alpha$ to a normal line parallel to the side surface and a lower partial surface which is inclined at an angle $\beta$ to the normal line, the angles $\alpha$ and $\beta$ having opposite rotational directions, the rabbet strip of the first shell having surfaces configured to correspond to the upper and lower partial surfaces of the groove strip.

2. A housing according to claim 1, wherein the angles $\alpha$ and $\alpha$ are of equal size.

3. A housing according to claim 1, wherein the upper partial surface is configured as a guide surface and the lower partial surface is configured as a locking surface.

4. A housing according to claim 3, the guide surface and the locking surface are planar surfaces.

5. A housing according to claim 3, wherein the guide surface and the locking surface are curved surfaces.

6. A housing according to claim 5, wherein the guide surface and the locking surface have an equal curvature and pass into one another in a continuous manner.

7. A housing according to claim 1, wherein the lateral side surfaces of the first shell are planar with the lateral side surfaces of the second shell.

* * * * *

UNITED STATES PATENT AND TRADEMARK OFFICE

CERTIFICATE OF CORRECTION

PATENT NO. : 5,875,821

DATED : March 2, 1999

INVENTOR(S) : Josef DUMSER, Karl-Heinz KOLASKA

It is certified that error appears in the above-identified patent and that said Letters Patent is hereby corrected as shown below:

Title page, item [73],
Please delete the name of the assignees in their entirety and insert the following therefor:

Dumser Metallbau GmbH & Co. KG, Landau;
Storopack Hans Reichenecker GmbH + Co.,
Metzingen, both of Germany Signed and Sealed this Twelfth Day of September, 2000

*Attest:*

Q. TODD DICKINSON

*Attesting Officer*

*Director of Patents and Trademarks*